US006196109B1

(12) United States Patent
Zumbusch et al.

(10) Patent No.: US 6,196,109 B1
(45) Date of Patent: Mar. 6, 2001

(54) AXIAL PISTON PUMP AND IMPROVED VALVE PLATE DESIGN THEREFOR

(75) Inventors: Steven J. Zumbusch, Chanhassen; Benjamin M. Hoxie, St. Paul; Maynard W. Marts, Bloomington, all of MN (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/193,322

(22) Filed: Nov. 16, 1998

(51) Int. Cl.[7] ..... F01B 31/00
(52) U.S. Cl. ..... 91/6.5; 92/72
(58) Field of Search ..... 91/6.5, 499; 92/72

(56) References Cited

U.S. PATENT DOCUMENTS

| | | | | |
|---|---|---|---|---|
| Re. 24,048 | | 8/1955 | Wright . | |
| 2,298,850 | | 10/1942 | Vickers . | |
| 2,313,407 | | 3/1943 | Vickers et al. | 91/505 |
| 2,915,985 | | 12/1959 | Budzich . | |
| 3,230,893 | | 1/1966 | Hann et al. . | |
| 3,249,061 | | 5/1966 | Ricketts . | |
| 3,585,901 | * | 6/1971 | Moon et al. | 91/6.5 |
| 4,075,933 | * | 2/1978 | Stephens | 91/506 |
| 4,426,914 | | 1/1984 | Kline . | |
| 4,757,743 | * | 7/1988 | Tovey | 91/6.5 |
| 4,920,856 | * | 5/1990 | Berthold et al. | 91/6.5 |
| 5,230,274 | * | 7/1993 | Yu et al. | 91/499 |
| 5,253,983 | * | 10/1993 | Suzuki et al. | 91/6.5 X |
| 5,358,388 | * | 10/1994 | Schutten et al. | 91/499 X |
| 5,590,579 | | 1/1997 | Weber . | |
| 5,593,285 | * | 1/1997 | Watts | 91/499 X |
| 5,727,441 | * | 3/1998 | Fu et al. | 91/6.5 |
| 6,024,541 | * | 2/2000 | Perstnev et al. | 91/6.5 X |

FOREIGN PATENT DOCUMENTS

| | | | | |
|---|---|---|---|---|
| 1346890 | * | 2/1963 | (FR) | 91/499 |
| 1268203 | * | 3/1972 | (GB) | 91/499 |
| 56-6080 | * | 1/1981 | (JP) | 91/499 |
| 769072 | * | 10/1980 | (RU) | 91/499 |
| 992809 | * | 1/1983 | (RU) | 91/499 |

* cited by examiner

*Primary Examiner*—John E. Ryznic
(74) *Attorney, Agent, or Firm*—L. J. Kasper

(57) ABSTRACT

A hydraulic unit of the type including a cylinder block (19) rotatably disposed adjacent a valve plate (51;61) having inlet ports 41*a*, 41*b*, and 41*c*, and further having outlet ports 43*a*, 43*b*, and 43*c*. Disposed between the individual inlet and outlet ports are web portions, having nominal cross-sections and flow restrictions. In one embodiment (FIG. 3), there is a modified web portion (55) toward the trailing end of the outlet port, and in the other embodiment (FIG. 7), there is a modified web portion (65) toward the leading end of the outlet port. In either case, the web portion has its cross-section or flow restriction modified to move the resultant force on the swashplate (33) in a direction tending to reduce the moments on the swashplate, and therefore, reduce the operator effort required to move or maintain the control lever.

6 Claims, 5 Drawing Sheets

AXIAL PISTON PUMP AND IMPROVED VALVE PLATE DESIGN THEREFOR

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE DISCLOSURE

The present invention relates to variable displacement hydraulic pumps having a rotating group of the axial piston type, and more particularly, to an improved valve plate for use in such pumps.

Among the types of axial piston pumps known to those skilled in the art is one in which the tiltable swashplate includes a pair of transversely opposed trunnions which are rotatably supported, relative to the pump housing, by suitable bearing means. A pump of the type described is sometimes referred to as a "trunnion pump." The other type of axial piston pump in widespread commercial use is of the "swash and cradle" type, as illustrated and described in U.S. Pat. No. 5,590,579, assigned to the assignee of the present invention and incorporated herein by reference. Those skilled in the art will understand that the present invention is illustrated and described in connection with a trunnion pump, but is equally applicable to a swash and cradle type pump.

In a typical axial piston pump, whether of the trunnion or swash and cradle type, there is a rotating cylinder barrel which includes a plurality (typically, an odd number) of reciprocating pistons. The pistons engage the cam or swashplate, the position of which may be fixed, but more typically, may be varied to adjust the displacement of the pump. The end of the cylinder barrel opposite the swashplate could be seated directly against the backplate, but more typically, is seated against a valve plate. The valve plate defines a fluid inlet and a fluid outlet which, in turn, are connected, through passages in the backplate, to the pump inlet port and the pump outlet port, respectively, defined by the pump housing.

In the early days of axial piston pumps, the valve plate merely defined a pair of arcuate, substantially identical ports, with each port being open, through the thickness of the valve plate, and throughout the entire circumferential extent of the port, which would typically be about 150° or 160°. See for example U.S. Pat. No. 2,915,985, incorporated herein by reference. However, in valve plates of the type utilized in the cited patent, there were concerns regarding the strength and durability of the valve plate, in view of the continuous, arcuate form of the inlet and outlet. Typically, there was no substantial clamping load applied axially on the valve plate, and therefore, the pressurized fluid in the high pressure port would apply a radial load to the portion of the valve plate radially outward from the port, and could cause the plate to fail.

The concern regarding the strength of the valve plate led those skilled in the art to replace each of the individual arcuate ports (inlet or outlet) with a series of separate ports, with each adjacent port being separated by a "web" portion, which would typically be of the same material and thickness as the rest of the valve plate. Typically, each port (inlet or outlet) would consist of two or three individual ports arranged such that communication of the port with a particular kidney of the cylinder barrel would begin at the same time and end at the same time as when the port comprised one continuous port. In other words, the web portions were simply locations in the port where the port was discontinued, and were included to add strength to the valve plate. See for example U.S. Pat. No. 3,249,061, incorporated herein by reference.

Over the years, those skilled in the art have modified the inlet and outlet ports of the valve plate in various ways, typically, in an attempt to optimize valve timing in such a way as to reduce the noise generated by the pump. As used herein, the term "valve timing" refers to the relationship of each piston in the cylinder barrel, and its associated kidney (and when expansion and contraction occurs) relative to the beginning and end of communication of the cylinder kidney with the inlet and outlet ports in the valve plate.

Another important performance criteria of axial piston pumps is that of swashplate moments, i.e., forces on the swashplate tending to bias the swashplate back toward, or away from, the neutral (zero displacement) position. Swash moments is an especially significant issue in the case of manually controlled axial piston pumps, i.e., those wherein swashplate position is manually selected by the operator, for example, by means of movement of a handle or control lever, external to the pump, which is connected to the swashplate such that the movement of the handle directly and mechanically moves the swashplate. Typically, the control lever, external to the pump, includes a biasing spring, tending to bias the lever back toward the neutral position, the force of the biasing spring normally being selected such that it compensates for the "worst case" moments on the swashplate. Thus, the intention is that the force to be exerted by the operator is always in the same direction, i.e., the spring force is great enough that the operator is required to push on the lever under one particular operating condition, to achieve a certain pump displacement, but is required to pull on the lever under another operating condition, to achieve the same pump displacement.

It has been known to those skilled in the art that there are forces on the swashplate caused by the pressurized pistons, and these forces generate a resultant force on the swashplate. The magnitude of the resultant force, and its distance from the pivot axis of the swashplate, determine the moments on the swashplate, and in turn, the amount of force, and the direction of the force, which must be exerted by the operator in order to move the swashplate to change the pump displacement, or even to maintain the swashplate in its current position. As will be illustrated in greater detail subsequently, with the swashplate displaced in a "forward" direction (as shown in FIG. 1), having the resultant force located below the pivot axis (a "positive" moment) will tend to drive the swashplate back toward the neutral position, whereas, having the resultant force located above the pivot axis (a "negative" moment) will tend to drive the swashplate toward greater displacement.

It has also been generally understood by those skilled in the art that valve plate timing would have an impact on the location of the resultant force. However, changing valve plate timing as a way of trying to reduce swash moments has the disadvantage that, in a certain application, the change in valve timing needed to reduce swash moments may result in noisier pump operation, or pump operation which is less efficient in the sense of permitting cross port leakage, which is well known to those skilled in the art.

BRIEF SUMMARY OF THE INVENTION

Accordingly, it is an object of the present invention to provide an improved axial piston pump having the capability of reduced operator control forces, caused by swashplate moments.

It is a more specific object of the present invention to provide such an improved axial piston pump and an improved valve plate wherein control forces may be reduced without changes in valve plate timing.

It is a related object of the present invention to provide such an improved axial piston pump and an improved valve plate wherein the variation in swash moments, with changes in system pressure, may be substantially reduced.

It is another object of the present invention to provide such an improved axial piston pump wherein the valve plate design may be modified in such a way as to provide either positive or negative swash moments, or to either increase or decrease the swash moments, at the option of the designer.

The above and other objects of the invention are accomplished by the provision of a hydraulic unit of the type including a housing, an input shaft rotatably supported relative to the housing, a cylinder block rotatably disposed within the housing and operably associated with the input shaft for rotation therewith. The cylinder block defines a plurality N of cylinders, and a piston disposed for reciprocation within each of the cylinders, in response to rotation of the cylinder block, the amount of reciprocation of the pistons being determined by the tilt angle of a tiltable swashplate having a resultant force acting thereon. The housing defines a fluid inlet and a fluid outlet and the cylinder block defines a cylinder port associated with, and in open communication with each of the cylinders. Each of the cylinder ports is disposed for serial communication with the fluid inlet and the fluid outlet during rotation of the cylinder block. The fluid outlet comprises at least a pair of arcuate outlet portions separated by a first web portion disposed generally toward a trailing end of the fluid outlet.

The improved hydraulic unit is characterized by the first web portion having a nominal cross-section and nominal flow restriction. The first web portion has its nominal cross section and flow restriction modified to move the resultant force on the swashplate in a direction tending to reduce the moments on the swashplate during rotation of the cylinder block.

In accordance with a more specific aspect of the invention, the fluid outlet comprises three arcuate outlet portions separated by a second web portion disposed generally toward a leading end of the fluid outlet, in addition to the first web portion disposed generally toward the trailing end of the fluid outlet, which has its nominal cross-section and nominal flow restriction reduced by means of an undercut of the web portion at the valve surface, but wherein the second web portion has the nominal cross-section and nominal flow restriction.

DETAILED DESCRIPTION OF THE PREFERRED EMBODIMENT

Figure 1:
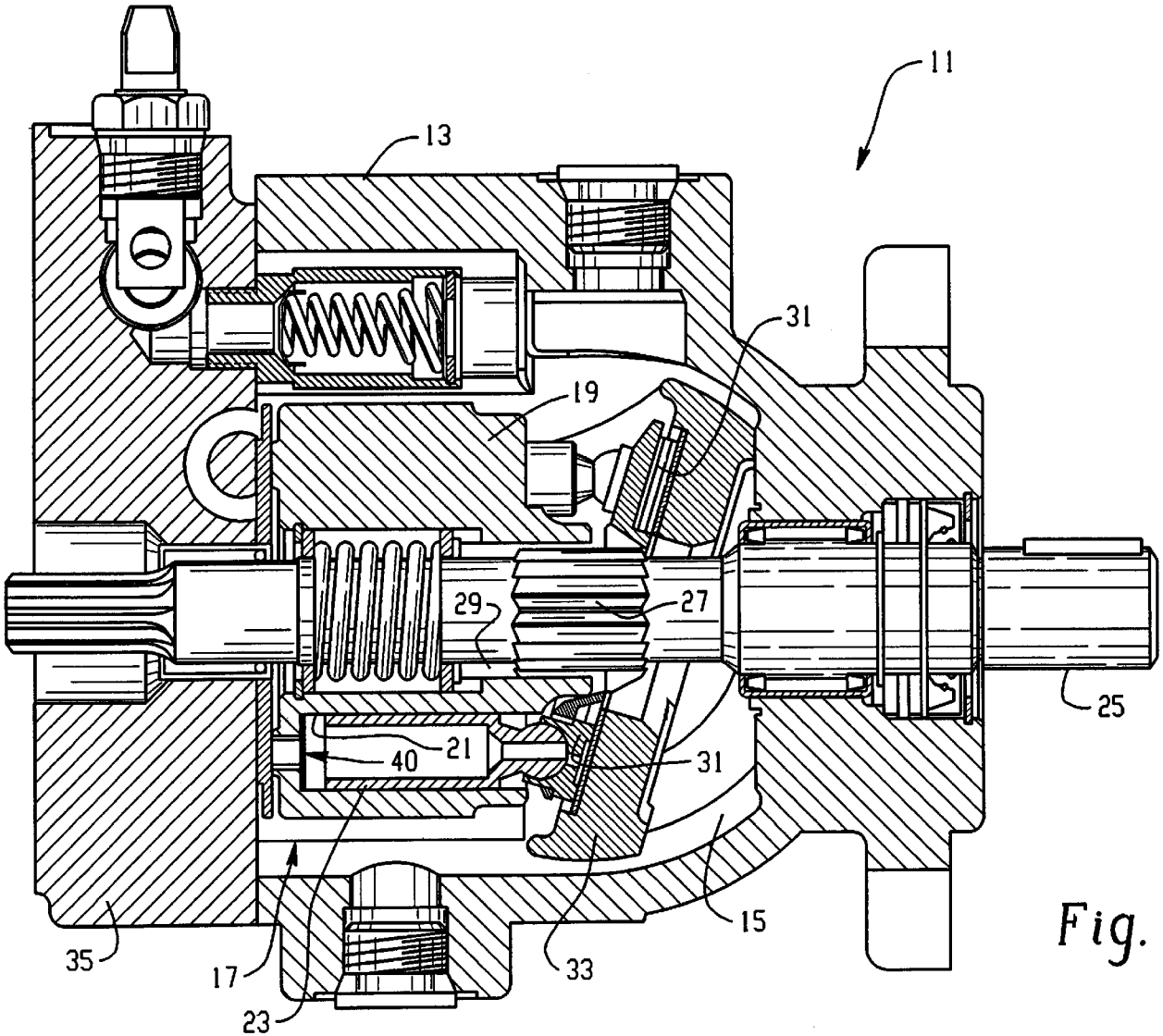
FIG. 1 is an axial cross-section of an axial piston pump of the type with which the present invention may be utilized.

Referring now to the drawings, which are not intended to limit the invention, FIG. 1 illustrates an axial cross-section of an axial piston pump of the "trunnion" type, although as described in the BACKGROUND OF THE DISCLOSURE, the present invention is equally suitable for use with an axial piston pump of the swash and cradle type.

The axial piston pump, generally designated 11, includes a main pump housing 13, within which is a pumping chamber 15. Disposed within the pumping chamber 15 is a rotating group (pumping element), generally designated 17. In the subject embodiment, the rotating group 17 comprises a rotatable cylinder barrel 19 defining a plurality of cylinders 21 (only one of which is shown in FIG. 1). Disposed within each cylinder 21 is a piston 23, which is reciprocable within the cylinder 21 to pump fluid therefrom in a manner well known to those skilled in the art, whenever the cylinder barrel 19 is rotating, and the pump is at some displacement other than zero.

The rotating group 17 receives input torque from an input shaft 25, which extends through substantially the entire axial length of the pump. The input shaft 25 includes a set of external splines 27, which are in engagement with a set of internal splines 29 defined by the cylinder barrel 19, such that rotation of the input shaft 25 results in rotation of the barrel 19.

Each piston 23 is seated, by means of a slipper member 31, against a transverse surface of a swashplate 33, as the cylinder barrel 19 rotates relative to the rotationally-stationary swashplate 33. Although the swashplate 33 does not rotate about the axis of rotation of the input shaft 25, it is well known to those skilled in the art that the swashplate 33 tilts or pivots about a transverse pivot axis (not shown herein). Those skilled in the art will understand that references to "swash moments" means the moments acting on the swashplate 33, either tending to move the swashplate toward neutral (zero displacement) which would be vertical in FIG. 1, or tending to move the swashplate toward a greater displacement.

Figure 2:
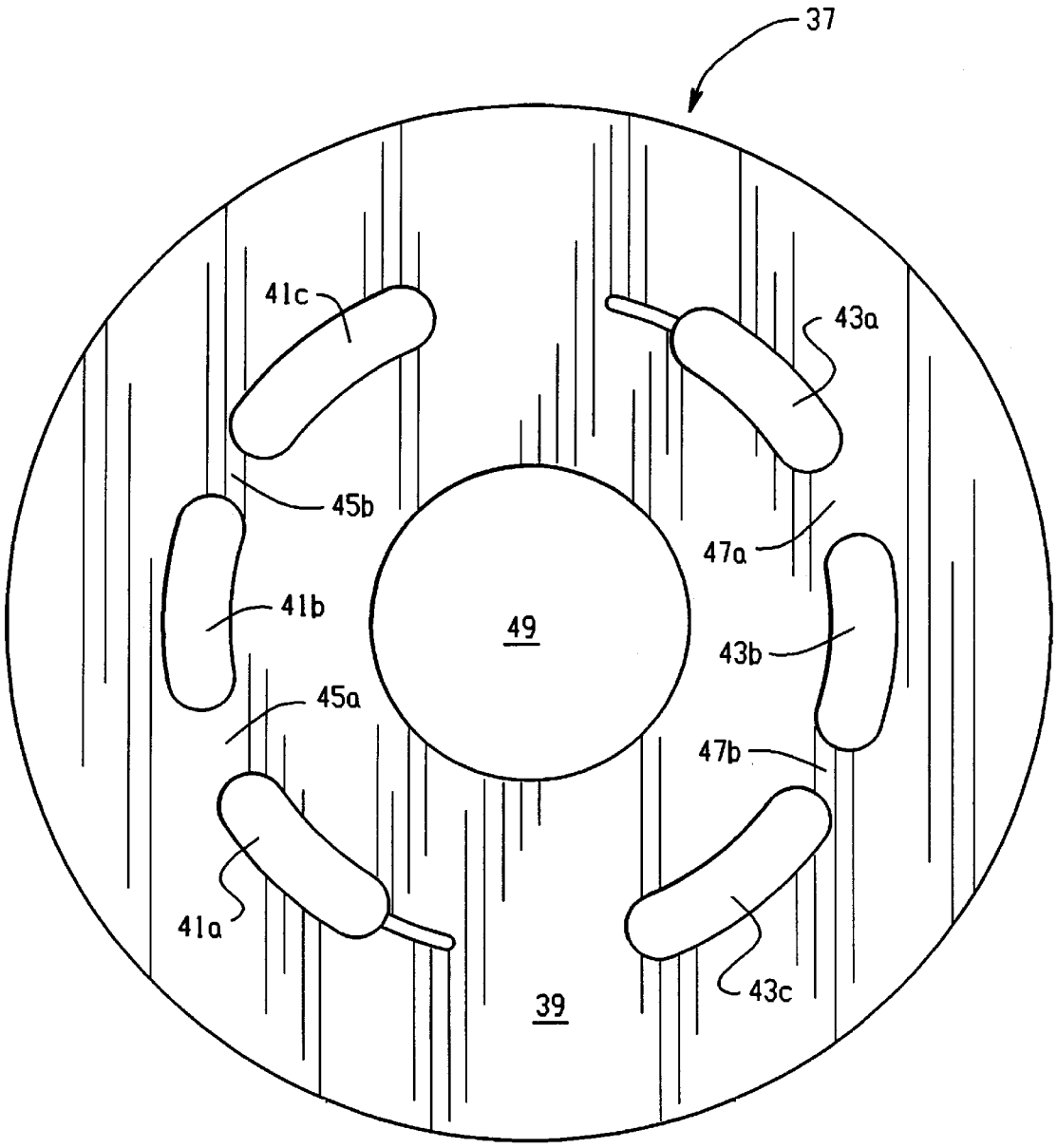
Fig. 2 (PRIOR ART)
FIG. 2 is a front plan view (from the left in FIG. 1) of a typical "prior art" valve plate of the type used in the axial piston pump of FIG. 1.

The pump 11 also includes an end cap 35 which typically defines a pump inlet port and a pump outlet port (not shown in FIG. 1). Disposed axially between a rearward surface of the cylinder barrel 19 and a forward surface of the end cap 35 is a valve plate 37, with FIG. 2 illustrating a plan view (from the right in FIG. 1) of a "prior art" valve plate 37. The valve plate 37 has a forward surface 39 which comprises a "valve surface", i.e., a surface at which interaction occurs between a kidney 40 of each cylinder 21 and the inlet and outlet ports of the valve plate 37.

For purposes of subsequent description, it will be assumed that the cylinder barrel 19 is rotating clockwise in FIG. 2, such that the left hand side of the valve plate 37 comprises an inlet (suction) region, generally designated 41, while the right hand side of the valve plate 37 comprises an outlet (pressure) region, generally designated 43, of the valve plate.

As was described in the BACKGROUND OF THE DISCLOSURE, in order to maintain sufficient rigidity and strength of the valve plate 37, the practice of having one continuous arcuate inlet port and one continuous arcuate outlet port has been discontinued. Instead, and by way of example only and not limitation, the valve plate 37 includes three inlet ports 41*a*, 41*b* and 41*c*, which are designated in the order in which 25 they communicate with each individual cylinder kidney. Similarly, the valve plate 37 includes three outlet ports 43*a*, 43*b* and 43*c*. Again, the ports are designated in the order in which they communicate with each individual cylinder kidney.

The inlet ports 41*a* and 41*b* are separated by a web portion 45*a*, and the inlet ports 41*b* and 41*c* are separated by a web portion 45*b*. Similarly, the outlet ports 43*a* and 43*b* are separated by a web portion 47*a*, while the outlet ports 43*b* and 43*c* are separated by a web portion 47*b*. Typically, the valve plate 37 would be formed by a stamping process in which the inlet ports 41*a*, 41*b*, and 41*c*, outlet ports 43*a*, 43*b*, and 43*c*, as well as a central opening 49 would be formed by a stamping or fine line blanking type of operation. Therefore, the web portions 45*a*, 45*b*, 47*a* and 47*b* would typically comprise portions of the valve plate where no port or opening had been formed, and therefore, the web portions would typically comprise the same material and thickness as the rest of the valve plate 37. It will be appreciated by those skilled in the art that for any given pump configuration, the "prior art" web portions 45*a*, 45*b*, 47*a* and 47*b* have a certain nominal cross-section, and provide a certain, nominal flow restriction as each of the cylinder kidneys 40 passes over the inlet region 41, then the outlet region 43.

Figure 3:
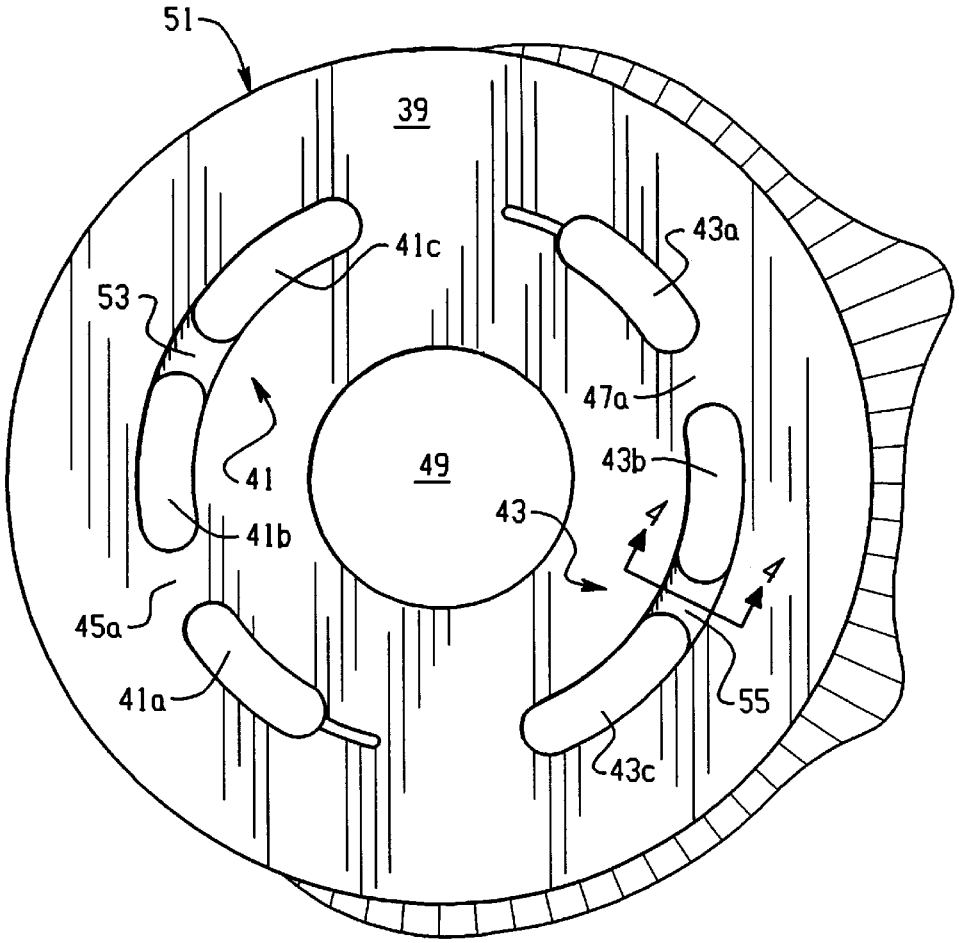
FIG. 3 is a front plan view of one embodiment of the valve plate of the present invention, on a smaller scale than FIG. 2, and including a graphical representation of the pressure-displacement relationship.
Figure 4:
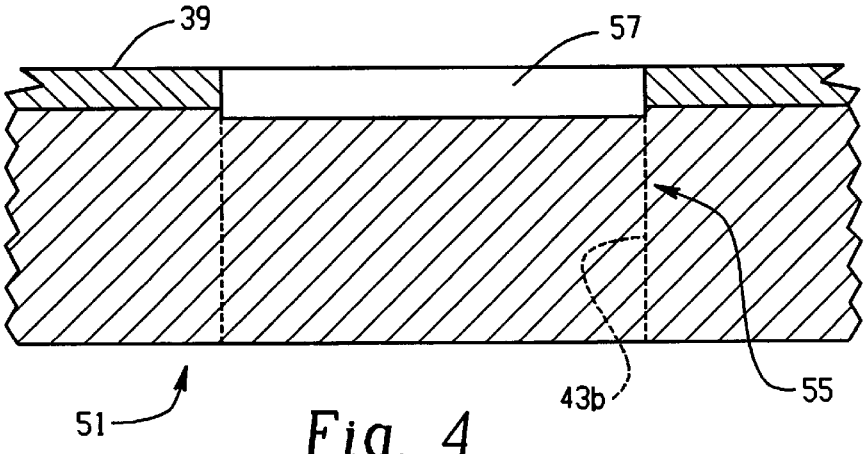
FIG. 4 is an enlarged, fragmentary, transverse cross-section through the valve plate, taken on line 4—4 of FIG. 3.

Referring now primarily to FIGS. 3 and 4, one important aspect of the present invention has been the recognition that modifying the cross-section and/or the flow restriction of the web portion disposed toward a trailing end of the fluid outlet 43 could reduce the moments on the swashplate 33 during rotation of the cylinder block 19.

In FIGS. 3 and 4, like elements will bear like numerals, but new or substantially modified elements will bear reference numerals in excess of "50". FIGS. 3 and 4 illustrate a valve plate 51 made in accordance with the present invention, wherein the valve plate 51 defines the inlet ports 41*a*, 41*b*, and 41*c* and further defines the outlet ports 43*a*, 43*b*, and 43*c*. In addition, the valve plate 51 defines the web portions 45*a* and 47*a*, each having the same nominal cross-section and nominal flow restriction as in the "prior art" valve plate 37. Finally, the valve plate 51 defines the same central opening 49 as in FIG. 2.

The web portions 45*a* and 47*a* are referred to as being disposed generally toward a leading end of the fluid inlet and fluid outlet, respectively, because as each cylinder kidney 40 (still assuming clockwise rotation of the barrel 19) traverses the valve plate 51, the individual cylinder kidney 40 first passes over the inlet port 41 a and then the web portion 45*a*, on the inlet side, and later passes over the outlet port 43*a* and then the web portion 47*a*, on the outlet side.

In accordance with the present invention, disposed toward the trailing end of the fluid inlet, i.e., between the inlet ports 41*b* and 41*c*, is a modified web portion 53. Similarly, disposed toward the trailing end of the fluid outlet, i.e., between the outlet port 43*b* and the outlet port 43*c* is a modified web portion 55. In the subject embodiment, the modified web portions 53 and 55 differ from the "prior art" web portions 45*b* and 47*b*, by defining an undercut, or recessed area 57 (see FIG. 4). Those skilled in the art will understand that the presence of the undercut 57 modifies the cross-sectional area (or more accurately, the cross-sectional volume) of the web portions 53 and 55, as well as the restriction to flow of the web portions 53 and 55. It will be understood that both of the web portions 53 and 55 are so modified in order that the pump may be bi-directional in operation. In other words, if the swashplate 33 is displaced in the opposite direction, the region 43 will become the inlet, and the region 41 will become the outlet, in which case the web portion 53 will comprise the web portion disposed toward the trailing end of the fluid outlet.

Figure 6:
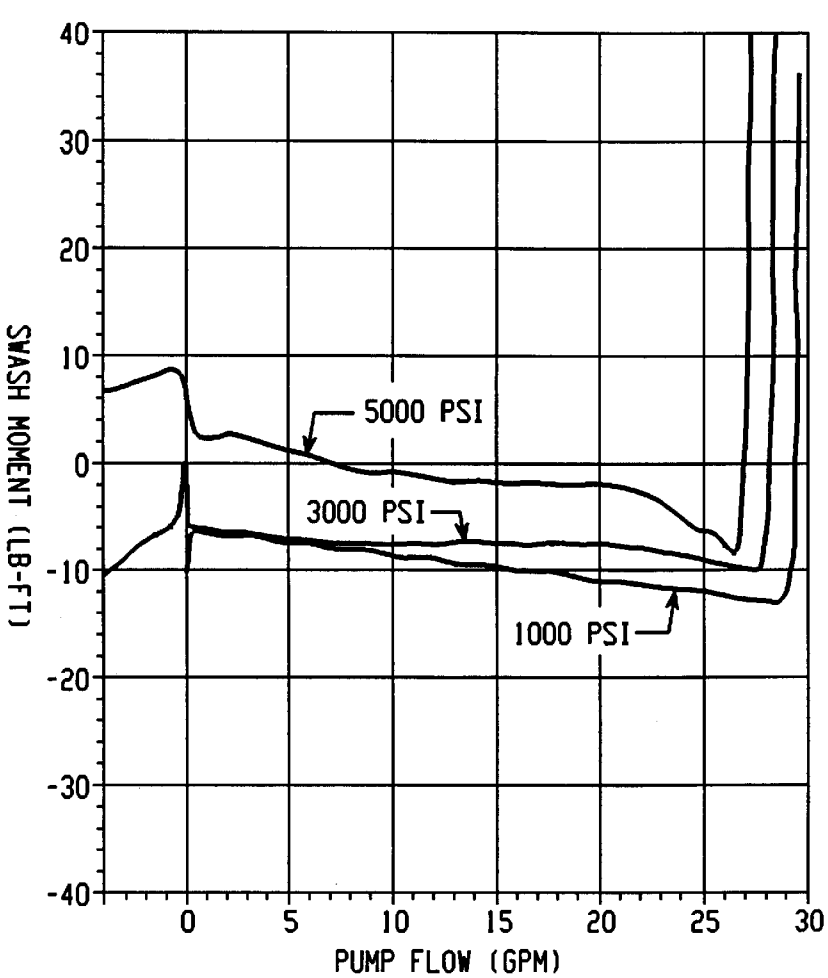
FIG. 6 is a graph of swash moments versus pump flow at several different pressure levels for the valve plate of the present invention.
Figure 5:
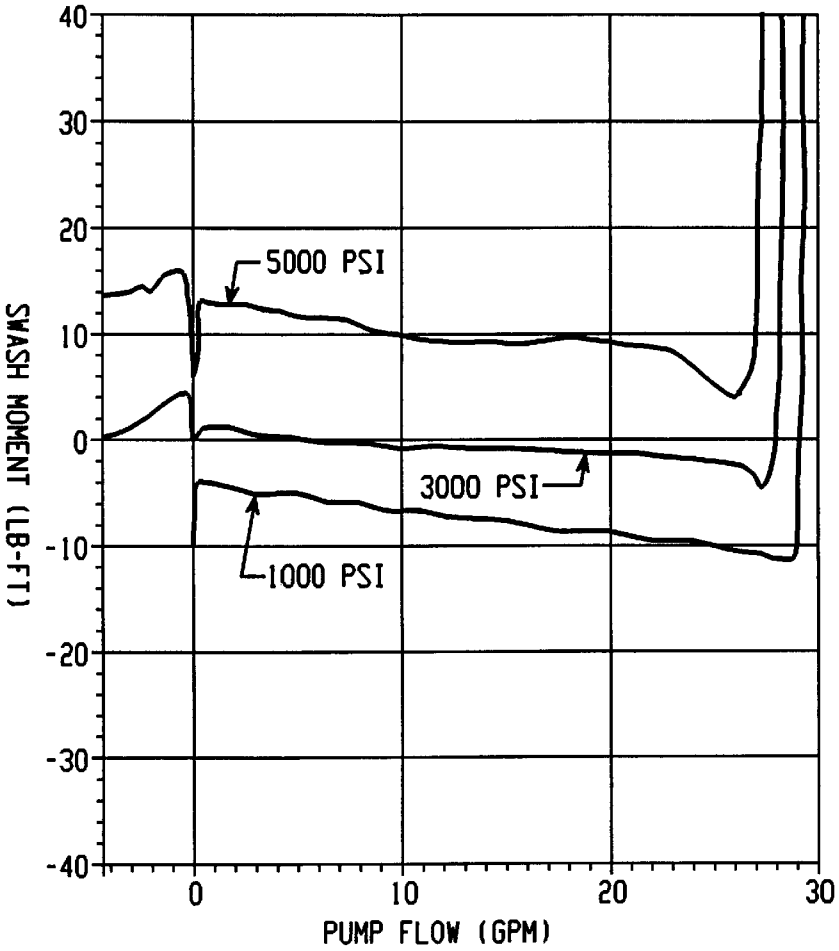
Fig. 5 (PRIOR ART)
FIG. 5 is a graph of swash moments versus pump flow at several different pressure levels, illustrating the prior art valve plate.

Referring now primarily to FIGS. 5 and 6, some of the benefits of the present invention will be described further. It should be noted that in each of FIGS. 5 and 6, the graphs are based upon the identical pump, operating at an input speed of 2400 rpm, which is sometimes referred to as "high idle" and represents a typical operating condition. The flow rate increased from zero to about 25 g.p.m., simply by increasing swashplate angle, with the tests being run at 1000, 3000 and 5000 psi. In FIG. 5, the pump swashplate moments range from about minus 10 lb-ft to about plus 13 lb-ft, which would suggest the need for a spring force of at least about 10 lb so that the operator always "feels" a positive force. Thus, at times, the operator would be required to exert a force of about 23 lb to move or just maintain the control lever.

With the present invention, and as seen in FIG. 6, the pump swashplate moments range from about minus 12 lb-ft to about plus 4 lb-ft, which would again suggest the need for a spring force of about 10 or 12 lb, in order that the operator always "feels a positive force. In FIG. 6, the result would be that the operator would never be required to exert a force greater than about 14 or 16 lb., instead of the 23 lb required without the invention. Thus, the present invention makes it possible for the pump swash moments to stay within a narrower range, such that the design of the control lever, etc., is simplified and can result in substantially lower effort by the operator.

Figure 7:
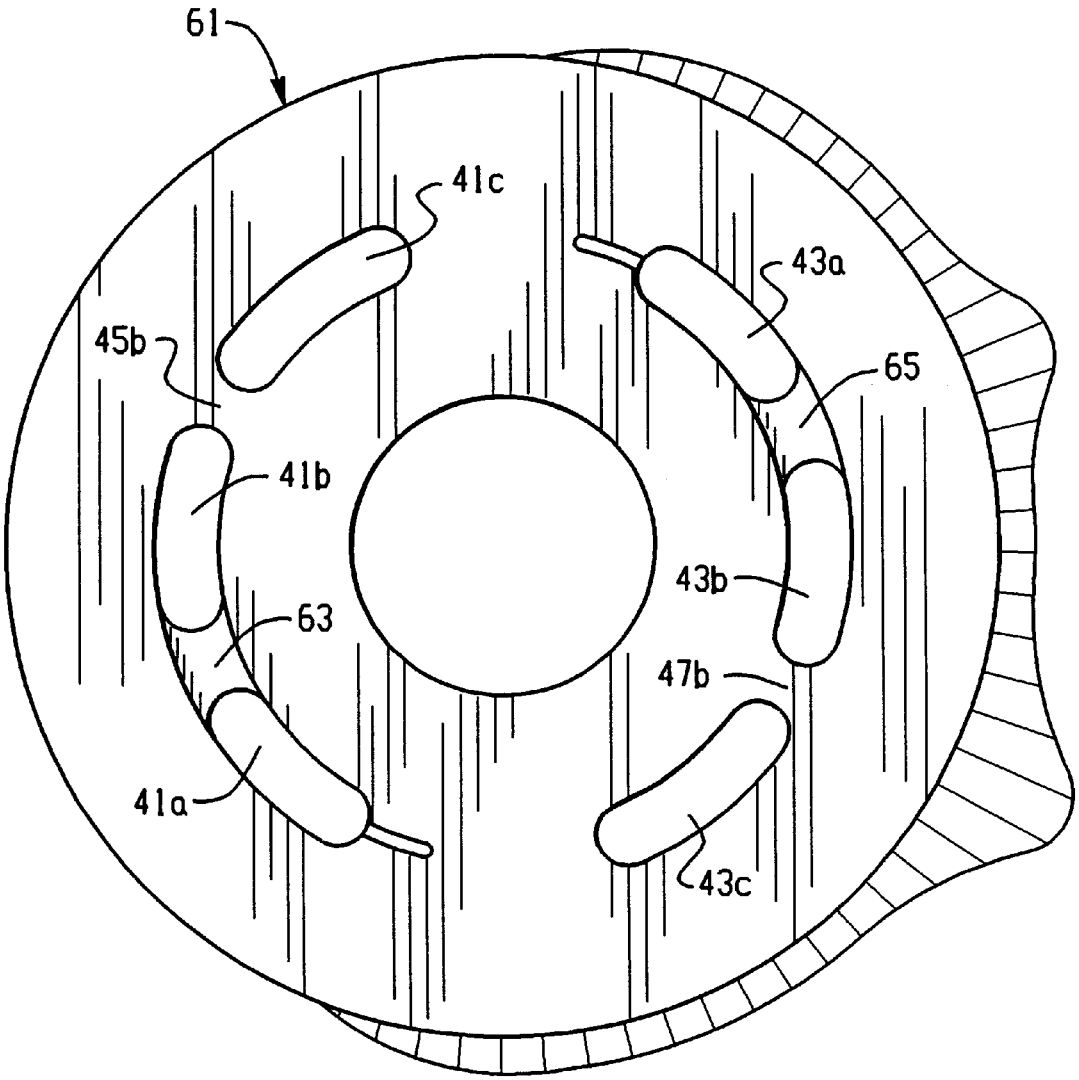
FIG. 7 is a front plan view of another embodiment of the valve plate of the present invention, on the same scale as FIG. 3, and also including a graphical representation of the pressure-displacement relationship.

Referring now primarily to FIG. 7, there is illustrated an alternative embodiment of the invention in which like elements bear like numerals (as compared to the "PRIOR ART" valve plate of FIG. 2), and new or substantially modified elements will bear reference numerals in excess of "60". In FIG. 7, there is a valve plate 61 defining the inlet ports 41*a*, 41*b*, and 41*c*, and the outlet ports 43*a*, 43*b*, and 43*c*. In the FIG. 7 embodiment, the inlet ports 41*b* and 41*c* are separated by the web portion 45*b*, and the outlet ports 43*b* and 43*c* are separated by the web portions 47*b*, as in the FIG. 2 embodiment. However, in accordance with another aspect of the invention, the valve plate 61 has modified web portions 63 and 65, which may also be configured as shown in FIG. 4. The web portion 63 separates the inlet ports 41*a* and 41*b*, while the web portion 65 separates the outlet ports 43*a* and 43*b*.

As may be seen by comparing FIG. 7 to FIG. 3, and specifically referring to the pressure-displacement relationship on the right side of each figure, the greater pressure was generated in the FIG. 3 version in the region of the "regular" or unmodified web portion 47*a*, but in the region of the web portion 55, a lesser pressure was generated. Thus, it is hypothesized that the lesser pressure in the region of the web portion 55 resulted in the resultant force moving closer to the pivot axis, reducing the overall swash moment. In the FIG.

7 version, the greater pressure is now in the region of the unmodified web portion 47*b*, while the lesser pressure is in the region of the modified web portion 65, such that the resultant force moves "downward" relative to the pivot axis. This modification would be useful in the case of a pump design which tended to have fairly high negative swash moments, indicating a resultant force above the pivot axis, and the valve plate 61 would increase such moments.

Thus, the present invention provides a means for modifying the valve plate in a way which enables the designer to effectively "tailor" the swash moments, within reasonable limits, to achieve improved control forces, to be exerted by the operator.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A hydraulic unit of the type including a housing, an input shaft rotatably supported relative to said housing, a cylinder block rotatably disposed within said housing and operably associated with said input shaft for rotation therewith; said cylinder block defining a plurality N of cylinders, and a piston disposed for reciprocation within each of said cylinders in response to rotation of said cylinder block, the amount of reciprocation of said pistons being determined by the tilt angle of a tiltable swashplate having a resultant force acting thereon, said housing defining a fluid inlet and a fluid outlet and said cylinder block defining a cylinder port associated with, and in open communication with, each of said cylinders; each of said cylinder ports being disposed for serial communication with said fluid inlet and said fluid outlet during rotation of said cylinder block; said fluid outlet comprising at least a pair of arcuate outlet portions separated by a first web portion disposed generally toward a trailing end of said fluid outlet; characterized by:

(a) said first web portion having a nominal cross-section and nominal flow restriction;

(b) said first web portion having its nominal cross-section and flow restriction modified to move the resultant force on said swashplate in a direction tending to reduce the moments on said swashplate during rotation of said cylinder block; and (c) said fluid outlet comprising three arcuate outlet portions separated by a second web portion disposed generally toward a leading end of said fluid outlet, and said first web portion disposed generally toward said trailing end of said fluid outlet, said second web portion having said nominal cross-section and said nominal flow restriction.

2. A hydraulic unit as claimed in claim 1, characterized by said housing including a valve plate having a valve surface disposed in sliding engagement with said cylinder block during rotation thereof, said valve plate defining said fluid inlet and said fluid outlet.

3. A hydraulic unit as claimed in claim 2, characterized by said web portion toward said trailing end of said fluid outlet having said nominal cross-section and said nominal flow restriction reduced by means of an undercut of said web portion at said valve surface.

4. A hydraulic unit of the type including a housing, an input shaft rotatably supported relative to said housing, a cylinder block rotatably disposed within said housing and operably associated with said input shaft for rotation therewith; said cylinder block defining a plurality N of cylinders, and a piston disposed for reciprocation within each of said cylinders in response to rotation of said cylinder block, the amount of reciprocation of said pistons being determined by the tilt angle of a tiltable swashplate having a resultant force acting thereon, said housing defining a fluid inlet and a fluid outlet and said cylinder block defining a cylinder port associated with, and in open communication with, each of said cylinders; each of said cylinder ports being disposed for serial communication with said fluid inlet and said fluid outlet during rotation of said cylinder block; said fluid outlet comprising at least a pair of arcuate outlet portions separated by a first web portion disposed generally toward a leading end of said fluid outlet; characterized by:

(a) said first web portion having a nominal cross-section and nominal flow restriction;

(b) said first web portion having its nominal cross-section and flow restriction modified to move the resultant force on said swashplate in a direction tending to increase the moments on said swashplate during rotation of said cylinder block; and (c) said fluid outlet comprising three arcuate outlet portions separated by a second web portion disposed generally toward a trailing end of said fluid outlet, and said first web portion disposed generally toward said leading end of said fluid outlet, said second web portion having said nominal cross-section and said nominal flow restriction.

5. A hydraulic unit as claimed in claim 4, characterized by said housing including a valve plate having a valve surface disposed in sliding engagement with said cylinder block during rotation thereof, said valve plate defining said fluid inlet and said fluid outlet.

6. A hydraulic unit as claimed in claim 5, characterized by said web portion toward said leading end of said fluid outlet having said nominal cross-section and said nominal flow restriction reduced by means of an undercut of said web portion at said valve surface.

* * * * *